US005480575A

United States Patent [19]

Altieri et al.

[11] Patent Number: 5,480,575

[45] Date of Patent: Jan. 2, 1996

[54] ADJUNCTS DISSOLVED IN MOLECULAR SOLID SOLUTIONS

[75] Inventors: Paul A. Altieri, Belle Mead; James Eden, East Millstone, both of N.J.; Michael C. Gribnau; Leendert Hoogendijk, both of Vlaardingen, Netherlands; Lambertus B. Krijnen, Rotterdam, Netherlands; Daniel B. Solarek, Belle Mead, N.J.; Ton Swarthoff, Hellevoetsluis, Netherlands

[73] Assignee: Lever Brothers, Division of Conopco, Inc., New York, N.Y.

[21] Appl. No.: 160,538

[22] Filed: Dec. 1, 1993

[30] Foreign Application Priority Data

Dec. 3, 1992 [EP] European Pat. Off. ..... 92203753

[51] Int. Cl.[6] ..... C11D 7/54; C11D 3/37; C11D 3/22; C11D 17/08; C11D 3/395

[52] U.S. Cl. ..... 252/94; 252/174.13; 252/98; 252/106; 252/118; 252/132; 252/99; 252/95; 252/174; 252/135; 252/174.17; 252/174.18; 252/174.23; 252/186.26; 252/186.25; 252/DIG. 6; 252/DIG. 11; 252/DIG. 14; 252/102; 252/186.31; 252/186.38; 252/104; 252/141; 252/162; 252/186.33; 252/186.27; 502/167; 502/150; 502/159

[58] Field of Search ..... 252/174.13, 90, 252/91, 92, 93, 98, 106, 118, 119, 120, 130, 132, 99, 95, 174.12, 174, 174.17, 174.18, 135, 174.23, 186.26, 186.25, 526, 354, 356, DIG. 6, DIG. 11, DIG. 14, 102, 186.31, 186.38, 94, 104, 162, 186.33, 141, 186.27; 502/167, 150, 159; 435/188

[56] References Cited

U.S. PATENT DOCUMENTS

| | | | |
|---|---|---|---|
| 4,009,113 | 2/1977 | Green et al. | 252/174 X |
| 4,090,973 | 5/1978 | Maguire, Jr. et al. | 252/174 X |
| 4,208,370 | 6/1980 | Häberli et al. | 264/117 |
| 4,457,858 | 7/1984 | Saran et al. | 252/186.38 X |
| 4,812,445 | 3/1989 | Eden et al. | 514/60 |
| 4,842,767 | 6/1989 | Warschewski et al. | 435/188 X |
| 5,194,416 | 3/1993 | Jureller et al. | 502/167 |
| 5,198,353 | 3/1993 | Hawkins et al. | 435/188 |
| 5,244,594 | 9/1993 | Favre et al. | 252/174.12 X |
| 5,246,621 | 9/1993 | Favre et al. | 252/174.12 X |
| 5,292,530 | 3/1994 | McCrea et al. | 424/66 |
| 5,302,377 | 4/1994 | Pereira et al. | 252/106 X |
| 5,433,881 | 7/1995 | Townend et al. | 252/174.13 X |
| 5,433,884 | 7/1995 | Altieri et al. | 252/174.23 |

FOREIGN PATENT DOCUMENTS

| | | | |
|---|---|---|---|
| 0070474 | 7/1982 | European Pat. Off. . | |
| 106634 | 4/1984 | European Pat. Off. . | |
| 0225663 | 6/1987 | European Pat. Off. . | |
| 339998 | 11/1989 | European Pat. Off. . | |
| 458397 | 11/1991 | European Pat. Off. . | |
| 499648 | 8/1992 | European Pat. Off. . | |
| 2338412 | 2/1974 | Germany . | |
| 4140830 | 12/1991 | Germany . | |
| 680924 | 10/1952 | United Kingdom . | |
| 1204123 | 9/1970 | United Kingdom | 252/106 |
| 92/11349 | 9/1992 | WIPO . | |

*Primary Examiner*—Douglas J. McGinty
*Attorney, Agent, or Firm*—Ronald A. Koatz

[57] ABSTRACT

A method of protecting sensitive or reactive adjuncts, preferably of the type incorporated in detergent compositions, by dissolving said adjunct in a biopolymer, thereby forming a stable particulate adjunct product comprising a molecular solid solution of adjunct in a biopolymer. Preferred adjuncts to be protected include bleach catalysts, bleach catalyst precursors, bleach precursors, enzymes, fluorescers, germicides, perfumes, anti-dye transfer and anti-dye damage agents and effervescent agents. The protected adjunct is especially useful for incorporation in non-aqueous liquid detergent compositions.

18 Claims, No Drawings

ADJUNCTS DISSOLVED IN MOLECULAR SOLID SOLUTIONS

The invention relates to the protection of adjuncts. In particular, it relates to a method of protecting an adjunct for use in product formulations, for example, detergent compositions and especially non-aqueous liquid detergent compositions.

Adjuncts or additives are important ingredients incorporated in products, usually in small amounts, and which in use have auxiliary beneficial effects. In the detergents art, it is known that it is difficult to satisfactorily add adjuncts such as bleach catalysts, bleach precursors and fluorescers into detergent compositions, especially into non-aqueous liquid detergent compositions. Such adjuncts may decompose, interact, discolour, separate out or segregate when incorporated into such products.

Whereas aqueous liquids contain relatively high proportions of water in the liquid phase, non aqueous liquids are those containing little or no water in the liquid phase.

An advantage of formulating non-aqueous liquids is that the solubility in them of bleaching agents, as well as that of other water-soluble components commonly included in detergent compositions and with which the bleach may otherwise react in an undesired manner, is extremely low.

Nevertheless, detrimental interactions may still occur in non-aqueous liquid compositions and so there is still a need to protect component such as bleaching agents and others which it is desired to incorporate because of their auxiliary beneficial effects during use.

Such sensitive components which may need to be protected include especially bleach catalysts and precursors thereto, enzymes, perfumes and fluorescers.

It is well known in the detergents art to protect sensitive solid components from an incompatible environment by separating them physically from their environment, for example, by encapsulation.

The known encapsulation methods often produce encapsulates which are incapable of standing-up to long term storage and/or are too expensive to be commercially viable.

A further potential problem with known systems is that the materials providing the protection may themselves have an adverse interaction with the component to be protected. This is especially so when the component is a reactive component material such as, for example, a bleaching agent or bleach catalyst.

A still further disadvantage with encapsulates is that they are generally bound to certain particle size constraints.

We have now found a method of protecting sensitive and reactive components which avoids, or at least reduces, the problems associated with prior art systems and which is particularly suitable for those components which are typically present in a composition in amounts of less than 5% by weight based on the total composition. Such components are hereinafter referred to as adjuncts.

Accordingly, the invention provides a method of protecting an adjunct by dissolving the adjunct in a biopolymer. Thus, in its broadest aspect the present invention provides a particulate adjunct product comprising a molecular solid solution of an adjunct in a biopolymer, said adjunct selected from bleach catalysts, bleach catalyst precursors, bleach precursors, fluorescers, germicides, perfumes, enzymes, anti-dye transfer and anti-dye damage agents, effervescent agents and mixtures thereof.

Effervescent agents find particular application in non-aqueous liquids improving the dissolution thereof in the wash liquor. Suitable materials include catalase, Cu(II) ions and a combination of citric acid and an alkalimetal bicarbonate.

The particulate product of the invention may comprise a molecular solid solution comprising one or more adjuncts in the biopolymer.

Preferred biopolymers include polysaccharides and polypeptides, such as starch, gelatin, pectin, casein, amylopectin (corn or potato), custard and modifications thereof, such as SCMC.

Suitable starches include potato starch, wheat starch, corn starch, waxy maize (waxy corn starch), cereal starch, rice starch, tapioca starch, amylopectin, amylose and mixtures and modifications thereof, such as depolymerised starch and dextrin octenylsuccinate derived from waxy maize starch.

Preferred starches for spray-drying are converted to a modified starch having a lower median molecular weight. The lower molecular weight starch preferably has a water fluidity (WF) of 20 to 80 WF, preferably 60 to 80 WF for spray-drying, or is a dextrin having a dextrose equivalent (D.E.) less than 3, or is a maltodextrin having a D.E. less than 20. For an anionic, hydrophobic system, such as a nonaqueous liquid detergent, ether or ester starch derivatives, such as octenylsuccinate starch ester or hydroxypropyl starch ether, having some hydrophobicity, are preferred. For the co-extruded starch little or no conversion (e.g., 0 to 40 WF) is preferred.

Starch may be modified by conversion to lower molecular weight starch biopolymers by degradation with acid or enzyme hydrolysis or by oxidation; by reaction with various reagents to form ether or ester substituents on the starch molecule; or by dextrinization by heat treatment under acidic conditions to form a lower molecular weight, water soluble dextrin. These modifications may be carried out singly or in combination.

Especially preferred are starches such as cellulose ethers (such as methylcellulose, ethylcellulose, hydroxylethylcellulose, methylhydroxy-ethyl-cellulose and methylhydroxy-propyl-cellulose) and starch ethers such as hydroxyethyl-starch and methylstarch.

Also especially preferred are starches modified with various ether and/or ester linkages, say with $C_1$ to $C_{20}$ alkyl side chains. Examples include octenylsuccinate or hydroxypropyl modified starches.

The degree of substitution (ds-value) is a term that is well-known in the art. Basically, it reflects the degree to which the —OH groups have been converted with substituent groups. Suitable ds-values for the starches are lower than 0.7, preferably 0.5 or lower, more preferably 0.3 or lower, most preferably 0.2 or lower, in particular 0.1 or lower. The ds value may be 0 or at least 0.01 or at least 0.02. Alginate has a ds value of 1.0 and SCMC of 0.7 or higher.

A high amylopectine content of starch is preferred in view of improved solubility and dispersability. Preferably the amylopectine content is 70% by weight or higher, more preferably 80%, most preferably 90% or higher based on the dry material. Preferably the amylose content is low, e.g. 10% by weight of the dry material or less, more preferably 20% or less, most preferably 30% or less.

Further examples of suitable biopolymers include amylose, tylose, whey proteins, zein, (hemi)celluloses, pentosans, chitin (e.g. derived form Shellfish), seaweed extracts such alginates, carrageenans, agar and furcelleran, pectines from plants, gums from sources such as arabic karya, tragacanth, locust bean, guar and xanthan.

An advantage of the use of these biopolymers is their natural source, which makes their synthesis and use environmentally acceptable.

The biopolymer should be chosen so as not to have any substantial adverse interactions with the adjunct to be protected.

It is known from GB 680 924 to form homogeneous solutions of starch or protein with sulphonate salts which solutions are subsequently dried. According to this reference starch or protein is present to enable efficient drying of the sulphonate salts without significant decomposition.

The use of temperature stabilised starch to encapsulate materials is known from U.S. Pat. No. 4,812,445. However, the process disclosed in this patent is one in which a dispersion of the starch is made. The present invention, is distinct therefrom in that the product as provided is in the form of a dehydrated homogeneous solution in solid form, which is more robust than the encapsulates taught in U.S. Pat. No. 4,812,445. Being in the form of a molecular solid solution the adjunct also disperses well in use on contact with water.

Normally the adjunct to be protected will constitute from about 0.01% to about 50% and preferably from about 0.1 to 30% by weight of the particulate adjunct product as a solid solution in the biopolymer.

The invention finds particular application in the protection of bleach catalysts and precursors thereto and, in particular, transition metal bleach catalysts for use in non-aqueous liquids. Such catalysts, which only need be present in such detergent composition in small amounts such as from 0.005 to 5%, preferably from 0.01 to 2% by weight of the composition, need to be protected from premature contact with other ingredients present to prevent any inactivation of the catalyst (for example by reaction with a nonionic surfactant present in the composition or with one or more of the other sensitive ingredients included in the composition, for example, percarbonate, perborate, perfume etc.)

Bleach catalysts may include those based on metal ions delivered by simple salts such as Cu(II) sulphate or those based on transition metal ion coordination complexes as described in, for example, EP-A-458397 and EP-A-458398.

Particularly preferred bleach catalysts include those comprising a source of Mn and/or Fe ions and a ligand L which is a macrocyclic organic compound of formula (I):

$$[NR^3-(CR^1(R^2)_u)_t]_s \quad \text{(I)}$$

wherein t is an integer from 2 to 3; s is an integer from 3 to 4, u is zero or one; each $R^1$, $R^2$ and $R^3$ are independently selected from H, alkyl, aryl, substituted alkyl, and substituted aryl.

Examples of preferred ligands are 1,4,7-triazacyclononane (TACN); 1,4,7-trimethyl-1,4,7-triazacyclononane (1,4,7-$Me_3$TACN); 2-methyl-1,4,7-triazacyclononane (2-MeTACN); 1,2,4,7-tetramethyl-1,4,7-triazacyclononane (1,2,4,7-$Me_4$TACN); 1,2,2,4,7-pentamethyl-1,4,7-triazacyclononane (1,2,2,4,7-$Me_5$TACN); and 1,4,7-trimethyl, 2-benzyl-1,4,7-triazacyclononane; and 1,4,7-trimethyl-2-decyl-1,4,7-triazacyclononane. Especially preferred is 1,4,7-trimethyl-1,4,7-triazacyclononane.

The aforementioned ligands may be synthesised by the methods described in K Wieghardt et al., Inorganic Chemistry 1982, 21, page 3086 et seq, incorporated herein by reference.

Another preferred ligand L comprises two species of formula (II)

$$[NR^4-(CR^1(R^2)_u)_t]_s \quad \text{(II)}$$

wherein t is an integer from 2 to 3;

s is an integer from 3 to 4;

u is zero or one;

each $R^1$ and $R^2$ are independently selected from H, alkyl, aryl, substituted alkyl and substituted aryl; and each $R^4$ is independently selected from hydrogen, alkyl, aryl, substituted alkyl and substituted aryl, with the proviso that at least one bridging unit $R^5$ is formed by one $R^4$ unit from each ligand where $R^5$ is the group $(CR^6R^7)_n$—$(D)_p$—$(CR^6R^7)_m$ where p is zero or one;

D is selected from a heteroatom such as oxygen and $NR^8$ or is part of an optionally substituted; aromatic or saturated homonuclear or heteronuclear ring, n is an integer from 1 to 4;

m is an integer from 1 to 4;

with the proviso that $n+m \leqq 4$;

each $R^6$ and $R^7$ are independently selected from H, $NR^9$ and $OR^{10}$, alkyl, aryl, substituted alkyl and substituted aryl; and each $R^8$, $R^9$, $R^{10}$ are independently selected from H, alkyl, aryl, substituted alkyl and substituted aryl.

An example of a preferred ligand of this type is 1,2-bis(4,7-dimethyl-1,4,7-triaza-1-cyclononyl)ethane, ([EB($Me_2$TACN)$_2$]).

The aforementioned ligands may be synthesised as described by K. Wieghardt et al in Inorganic Chemistry, 1985, 24, page 1230 et seq, and J. Chem., Soc., Chem. Comm., 1987, page 886, or by simple modifications of the synthesises.

In practising the invention for use in non-aqueous liquid detergent compositions, the ligand may be protected in the biopolymer as such or in the form of an acid salt, such as the HCl or $H_2SO_4$ salt, for example 1,4,7-$Me_3$TACN hydrochloride. The source of iron and/or manganese ions may be added separately as such or in a separate protected form or in the same particulate product together with the ligand.

The source of iron and manganese ions may be a water-soluble salt, such as iron or manganese nitrate, chloride, sulphate or acetate, or a coordination complex such as manganese acetylacetonate. The source of iron and/or manganese ions should be such that the ions are not too tightly bound, i.e. all those sources from which the ligand of formula (I), as hereinbefore defined, can extract the Fe and/or Mn in the bleaching solution.

Alternatively, the bleach catalyst may be in the form of a mono-, di- or tetranuclear manganese or iron complex.

Preferred mononuclear complexes have the general formula (III):

$$[L\ Mn\ X_p]^z Y_q \quad \text{(III)}$$

wherein

Mn is manganese in the II, III or IV oxidation state, each X represents a coordinating species independently selected from OR", where R" is a $C_1$–$C_{20}$ radical selected from the group consisting of, optionally substituted, alkyl, cycloalkyl, aryl, benzyl and radical combinations thereof or at least two R" radicals may be connected to one another so as to form a bridging unit between two oxygens that coordinate with the manganese, $Cl^-$ $Br^-$, $I^-$, $F^-$, $NCS^-$, $N_3^-$, $I_3$, $NH_3$, $OH^-$, $O_2^{2-}$, $HOO^-$, $H_2O$, SH, $CN^-$, $OCN^-$, $S_4^{2-}$, $R^{12}COO^-$, $R^{12}SO_4^-$, $R^{12}SO_3^-$ and $R^{12}COO^-$ where $R^{12}$ is selected from H, alkyl, aryl, substituted alkyl and substituted aryl and $R^{13}COO^-$ where $R^{13}$ is selected from alkyl, aryl, substituted alkyl and substituted aryl;

p is an integer from 1–3;

z denotes the charge of the complex and is an integer which can be positive, zero or negative;

Y is a monovalent or multivalent counter-ion, leading to charge neutrality, the type of which is dependent upon the charge z of the complex;

q=z/[charge Y]; and

L is a ligand of formula (I) as hereinbefore defined.

These mononuclear complexes are further described in Applicants copending European Patent Specification 549272 and U.S. Pat. No. 5194416.

Preferred dinuclear complexes have the formula (IV) or formula (V), see below

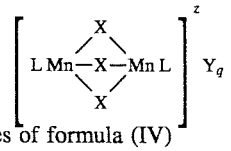

(IV)

In complexes of formula (IV)

each Mn is manganese independently in the III or IV oxidation state;

each X represents a coordinating or bridging species independently selected from the group consisting of $H_2O$, $O_2^{2-}$, $O^{2-}$, $OH^-$, $HO_2^-$, $SH^-$, $S^{2-}$, >SO, Cl, $N^{3-}$, $SCN^-$, $NH_2^-$, $NR_3^{12}$, $R^{12}SO_4^-$, $R^{12}SO_3^-$ and $R^{13}COO^-$ where $R^{12}$ is selected from H, alkyl, aryl, substituted alkyl, substituted aryl and $R^{13}COO^-$ where $R^{13}$ is selected from alkyl, aryl, substituted alkyl and substituted aryl;

L is a ligand of formula (I) as hereinbefore defined, containing at least three nitrogen atoms which coordinate to the manganese centres;

z denotes the charge of the complex and is an integer which can be zero, positive or negative;

Y is a monovalent or multivalent counter-ion, leading to charge neutrality, which is dependent upon the charge z of the complex; and q=z/[charge Y].

In dinuclear complexes of formula (V)

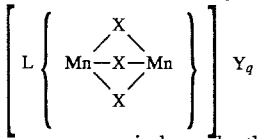

(V)

each Mn is manganese independently in the III or IV oxidation state;

each X represents a coordinating or bridging species independently selected from the group consisting of $H_2O$, $O_2^{2-}$, $O^{2-}$, $OH^-$, $HO_2^-$, $SH^-$, $S^{2-}$, >SO, Cl, $N^{3-}$, $SCN^-$, $NH_2^-$, $NR_3^{12}$, $R^{12}SO_4^-$, $R^{12}SO_3^-$ and $R^{13}COO^-$ where $R^{12}$ is selected from H, alkyl, aryl, substituted alkyl, substituted aryl and $R^{13}COO^-$ where $R^{13}$ is selected from alkyl, aryl, substituted alkyl and substituted aryl;

L is a ligand comprising two species of formula (II) with the proviso of at least one bridging unit as hereinbefore defined, and in which at least three nitrogen atoms of the ligand L are coordinated to each manganese centre;

z denotes the charge of the complex and is an integer which can be zero, positive or negative;

Y is a monovalent or multivalent counter-ion, leading to charge neutrality, which is dependent upon the charge z of the complex; and q=z/[charge Y].

Particularly preferred dinuclear manganese-complexes are those wherein each X is independently selected from $CH_3COO^-$, $O_2^{2-}$, and $O^{2-}$, and, most preferably, wherein the manganese is in the IV oxidation state and each X is $O^{2-}$. They include those having the formula:

i) $[Mn^{IV}_2\ (\mu\text{-}O)_3\ (1,4,7\text{-}Me_3TACN)_2](PF_6)_2$ ii) $[Mn^{IV}_2\ (\mu\text{-}O)_3\ (1,2,4,7\text{-}Me_4TACN)_2](PF_6)_2$ iii) $[Mn^{IV}_2\ (\mu\text{-}O)\ (\mu\text{-}OAc)_2\ (1,4,7\text{-}Me_3TACN)_2](PF_6)_2$ iv) $[Mn^{III}_2\ (\mu\text{-}O)\ (\mu\text{-}OAc)_2\ (1,2,4,7\text{-}Me_4TACN)_2](PF_6)_2$ v) $[Mn^{IV}_2\ (\mu\text{-}O)_2(\mu\text{-}O_2)\ (1,4,7\text{-}Me_3TACN)_2](PF_6)_2$ vi) $[Mn^{IV}Mn^{III}(\mu\text{-}O)_2(\mu\text{-}OAc)\ (EB\text{-}(Me_2TACN)_2)](PF_6)_2$ and any of these complexes but with other counterions such as $SO_4^{2-}$, $ClO_4^-$ etc.

Other dinuclear complexes of this type are further described in EP-A-458 397 and EP-A-458 398.

An example of a tetra-nuclear manganese complex is:

$$[Mn^{IV}_4(\mu\text{-}O)_6(TACN)_4](ClO_4)_4.$$

Any fluorescers commonly included in detergent compositions may be protected in the form of a molecular solid solution in a biopolymer. Usually such fluorescers are supplied and used in the form of their alkali metal salts, for example, the sodium salts. They include Tinopal® (Trade Mark) DMS or Tinopal® DBS available from Ciba-Geigy AG, Basel, Switzerland. Tinopal DMS is disodium 4,4' bis-(2-morpholino-4-anilino-s-triazin-6-ylamino) stilbene disulphonate; and Tinopal DBS is disodium 2,2-bis-(phenylstyryl)disulphonate. The total amount of the fluorescent agent or agents used in detergent compositions is generally from 0.02 to 2% by weight.

As stated above, enzymes may also be protected according to the invention. Suitable enzymes for incorporating into non-aqueous liquid compositions include proteases, for example Savinase® (Trade mark); lipases, for example Lipolase® (Trade mark); amylases, for example Termamyl® (Trade Mark) cellulases, for example celluzyme® (Trade mark) all supplied by Nove/Nordisk; and oxidases.

Particulate adjunct products according to the invention comprising biopolymer and adjunct may be incorporated in the non-aqueous liquid detergent compositions at any suitable level, for example up to 80%, preferably up to 40%, more preferably up to 20%, and typically within a range of between 0.1% and 20% by weight of the composition.

In one specific embodiment of the invention particulate adjunct products may constitute a mixture of compatible adjuncts. A preferred mixed adjunct product is, for example, one comprising a fluorescer and a bleach catalyst.

A further advantage of the present invention is the simple method of preparation. This involves forming a solution of the biopolymer in water in which a substantial amount, ie more than 50%, preferably more than 80% and, most preferably, more than 90% by weight, of the biopolymer has dissolved.

Thus, according to a further aspect of the invention there is provided a method of preparing a particulate product comprising substantially a molecular solid solution of an adjunct in a biopolymer, the method comprising:

i) dissolving the biopolymer in water to form a solution;

ii) dissolving the adjunct to be protected in the solution formed in step i); and iii) drying the solution of step i), thereby forming solid material.

Preferably this is followed by an additional step selected from extrusion, co-extrusion, agglomeration and spray coating with an additional biopolymer so as to provide an extra uniform coating which will further protect the adjunct. This additional step is designed to cover any exposed adjunct remaining after the initial step. Furthermore, this step, particularly when it involves co-extrusion, assists in providing a material which may be ground to the preferred particle size for a non-aqueous liquid detergent.

This may then be followed by reducing the size of the solid material of step (iii) to give the required particle size. Alternatively, it may be necessary to increase the particle size of the solid material of step (iii). This may be achieved by a method such as fluid bed agglomeration or extrusion.

By "substantially is meant at least 50%, preferably at least 80% and, most preferably, at least 90% of the particulate product is in the form of a molecular solid solution.

A preferred procedure is as follows:

The biopolymer is mixed with water at a weight ratio of biopolymer to water of from 1:99 to 50:50, more preferably 1:99 to 45:55 and, most preferably, 1:99 to 35:65. Thereafter, the mixture is heated as desired to ensure substantial dissolution of the biopolymer in water. The solution comprising the biopolymer and water is preferably allowed to cool to a temperature lower than 80° C., preferably lower than 50° C., before the adjunct is added. Thereafter, the resulting solution is allowed to stand so as to allow water to evaporate, thereby forming a solid material having a water content of not more than about 20% and preferably not more than 15% and, most preferably, not more than 10% by weight or dried.

Drying methods include freezedrying, microwave drying, vacuum drying, drum-drying, band-drying, spray-drying, tray-drying or any combination thereof. Using tray drying, the solution can be left to stand preferably at a temperature lower than 80° C., more preferably less than 50° C. to allow evapouration of water. The best results are obtained between 5° C. and 50° C. The evaporation process may be carried out in less than 1 hour, though preferably at least 1 hour, more preferably at least 5 hours. Of course, the resulting material can be subjected to higher temperatures e.g. at 80° C. or above at the beginning or at the end of the evapouration process, e.g. to eliminate any traces of water remaining.

Band drying is another useful method, preferably in combination with vacuum drying in which the solution is sprayed on a band in a chamber, preferably in a vacuum having a pressure of say from 10–20 mbar. The mixture is dried, e.g. for at least 10 minutes. This method has the advantage that it can easily be applied continuously.

Drum drying can also be used, i.e. the mixture of biopolymer, adjunct and water is sprayed on a turning drum, e.g. having a diameter of 300 mm, turning at a speed of 0.2 rpm and a temperature of above 100° C. The dry solubilised biopolymer material is scraped from the drum. This method has the advantage that it can easily be applied continuously.

Another method is spray drying a mixture of biopolymer and water. This method has the advantage that it can easily be applied continuously and can take as little as 1 minute.

Yet another method is extrusion of a mixture of biopolymer and water, e.g. using temperatures from 70° C. to 130° C. Optionally the dry solubilised bipolymer material is chopped into little pellets. This method also has the advantage that it can easily be applied continuously.

The most preferred method of drying is spray-drying.

The particulate product of the invention can be in the form of flakes, but is preferably presented in the form of regular small particles. Milling is a preferred method of reducing the size of the solid product. It can be carried out using any suitable size reduction equipment such as a mortar and pestle, a Janke & Kunkel Analysen Muhle A-10 operating at 20000 rpm, a ball, colloid, air-classifying or hammer mill. Finally, the solid product may be sieved to give material of the required particle size.

Particles to be added to non-aqueous liquid composition may be of any reasonable size. Since the biopolymer based particulate product's specific density is about the same as the liquid phase the particles will remain in suspension with substantially no tendency to separate out. However, very small particles are less desirable, because of dust during processing, whereas particles which are too large may yield grittiness. For the purpose of the invention the upper limit of the particle size is only determined by practical considerations and/or constraints such as the need to prevent segregation. Suitable particles may be of a size of up to 2000 μm, though preferably they should be not greater than 1000 μm, more preferably not greater than 400 μm. The particle size may even be of sub-micron size, such as 0.1 μm. Preferred particles will be greater than 1.0 μm, preferably greater than 10 μm, most preferably greater than 50 μm. In order to minimise interactions between the particles and the other ingredients of the liquid composition and to prevent segregation, it is preferred that the majority of particles ie >80% have a particle size within the range 100–250 μm.

This is another advantage of the product of the invention. Being a molecular solid solution stable particles can be made by grinding to any size, even to sub-micron, without loosing stability.

The present invention also extends to substantially non-aqueous liquid cleaning product compositions.

Thus, according to a further aspect, the invention provides a non-aqueous liquid cleaning composition comprising a liquid phase and a particulate product comprising a molecular solid solution of an adjunct in a biopolymer.

The biopolymer material may be used in the composition at levels of up to 80% by weight of the composition, preferably of up to 40%, more preferably of up to 20%, particularly preferred of up to 10%, e.g. lower than 5% by weight. The lower level will generally be about 0.01% by weight of the composition, preferably 0.01%, more preferably 0.2% and most preferably 0.5%, in particular 1.0% by weight.

Non-aqueous liquid detergent compositions are well-known in the art and described in numerous patent publications including U.S. Pat. Nos. 4,316,812, 4,874,537 and EP-A-484 095. The free water content of such compositions is typically less than 5% by weight, preferably less then 2% by weight, and, most preferably, is substantially absent.

Non-aqueous liquid detergent compositions generally comprise a liquid phase having incorporated therein as a dispersion, solution or combination thereof, components commonly found in detergent compositions such as surfactants and builders.

The liquid phase often comprises a nonionic surfactant as the major component which, apart from acting as a carrier liquid for the other detergent components usually and, preferably, is also active as a detergent.

Nonionic detergent surfactants are well-known in the art. They normally consist of a water-solubilising polyalkoxylene or a mono- or di-alkanolamide group in chemical combination with an organic hydrophobic group derived from, for example, alkylphenols in which the alkyl group contains from about 6 to about 12 carbon atoms, dialkylphenols in which each alkyl group contains from 6 to 2 carbon atoms, primary, secondary or tertiary aliphatic alcohols (or alkyl-capped derivatives thereof), preferably having from 8 to 20 carbon atoms, monocarboxylic acids having from 10 to about 24 carbon atoms in the alkyl group and polyoxypropylenes.

Fatty acid mono- and dialkanolamides in which the alkyl group of the fatty acid radical contains from 10 to about 20 carbon atoms and the alkyloyl group having from 1 to 3 carbon atoms are also common. In any of the mono- and dialkanolamide derivatives, optionally, there may be a polyoxyalkylene moiety joining the latter groups and the hydrophobic part of the molecule.

In all polyalkoxylene containing surfactants, the polyalkoxylene moiety usually consists of an average of from 2 to 20 groups of ethylene oxide or of ethylene oxide and propylene oxide groups. The latter class includes those described in European Patent Specification EP-A-225654, especially for use as all or part of the liquid phase.

Especially preferred are those ethoxylated nonionics which are condensation products of fatty alcohols with from 9 to 15 carbon atoms condensed with 3 to 7 moles of ethylene oxide. Examples of those are the condensation products of C11–13 alcohols with 3 or 7 moles of ethylene oxide. These may be used as the sole nonionic surfactant or in combination with those described in EP-A-225 654.

Another class of suitable nonionics include the alkyl saccharides (polyglycosides/oligosaccharides) and, in particular those described in the following patent specifications, U.S. Pat. No. 3,640,998; U.S. Pat. No. 3,346,558; U.S. Pat. No. 4 223 129; EP-A92 355; EP-A-99 183; EP-A-70 074; EP-A-70 075; EP-A-70 075; EP-A-70 076; EP-A-70 077; EP-A-75 994; EP-A-75 995 and EP-A-75 996.

Mixtures of different nonionic detergent surfactants may also be used. Mixtures of nonionic detergent surfactants with other detergent surfactants such as anionic, cationic or ampholytic surfactants and soaps may also be used.

Preferably the level of nonionic surfactant is from 10 to 90% by weight of the composition, more preferably from 20 to 70% by weight of the composition and, most preferably, from 35 to 50% by weight of the composition.

While nonionic surfactants are quite effective at removing oily and greasy stains, particulate soils such as clay soils may be more effectively removed by anionic surfactants. It may, therefore, be useful to use a combination of different surfactants.

Typical blends of surfactants include a nonionic and/or non-alkoxylated anionic and/or alkoxylated anionic surfactant. Cationic, zwitterionic and amphoteric surfactants may also be present in minor amounts as desired. These and other surfactants are described in "Surface Active Agents" Vol I, by Schwartz & Perry, Interscience 1949 and "Surface Active Agents" Vol II by Schwartz, Perry & Berch (Interscience 1958), in the current edition of "McCutcheon's Emulsifiers & Detergents" published by the McCutcheon division of Manufacturing Confectioners Company or in "Tensid_ Taschenbuch", H. Stache, 2nd Edn., Carl Hanser Verlag, Munchen & Wien.

Other liquid material which may be present in the liquid phase include liquid bleach precursors such as, for example, glyceroltriacetate, solvent material, for example, ethanol and dodecanol and deflocculant material as described in EP-A-266 199. The level of liquid precursors is preferably 0 to 20%, more preferably 1 to 25% and, most preferably, 2 to 10% by weight.

The level of solvents, other than nonionic surfactants is preferably from 0 to 20%, most preferably 0 to 15% and, more preferably, 0 to 10% by weight.

Deflocculant material, if included, may be present at levels of from 0 to 15%, preferably at least 0.01 and, most preferably, at least 1% by weight. For most purposes, the amount of deflocculant material will be from 2 to 12%, preferably 4 to 10% by weight based on the final composition.

Without wishing to be bound by any theory, it is believed the protective behaviour of the biopolymer in the product of the invention can be explained as follows. In water the biopolymer forms irregularly structured swollen aggregates with relatively wide channels (on an atomic scale) through which water can diffuse freely. This has been proven by pulsed field gradient NMR experiments on gelatin samples.

As a consequence thereof the water-soluble and dissolved adjunct, for example, a manganese complex catalyst, can freely enter the biopolymer aggregates as well. During evaporation the aggregates loose water and the channels narrow. The adjunct remains stuck in the biopolymer matrices and is thereby trapped within the biopolymer on a molecular level. In non-aqueous liquid formulations any nonionics cannot enter the narrow channels of the biopolymer. Polar polyethoxy groups may be able to enter the channels, but the apolar alkyl chains cannot, thereby prohibiting dissolution of the biopolymer. Water molecules on the other hand are small and do not contain an apolar part. They can, therefore, enter the biopolymer system quite easily, which explains the excellent dispersibility of the adjunct in water upon use.

Non-aqueous liquid detergent compositions according to the invention may comprise a solid dispersed phase, other than the particulate adjunct product. In such a case the liquid phase may preferably be from 20 to 80 and, most preferably, from 30 to 60% by weight of the composition.

Such solid dispersed phases include one or more components selected from bleach materials, solid bleach activators, builders, abrasives, enzymes and minor ingredients such as fluorescers. The latter two components may be included in the form of a particulate adjunct product according to the invention.

Usually the particle size of the solid phase in terms of D(3,2) will be less than 100 μm, preferably not more than 30 μm, more preferably up to 10 μm and more than 0.1 μm, preferably from 1 μm and, most preferably, from 2.5 μm. For the purposes of the present invention, references to the D(3,2) average particle diameter refer to the D(3,2) particle size, which is an average surface weighted, volume/weight mean diameter determined as described by M. Alderliesten, Anal., Proc. Vol. 21, May 1984, 167–172. The particle size can, for example, be determined using a Malvern Mastersizer or a Coulter LS 130, as appropriate.

Suitable bleaches for inclusion in the detergent compositions of the invention include halogen, particularly chlorine bleaches such as are provided in the form of alkali-metal hypohalites, eg hypochlorites. When the compositions of the invention are to be used for fabric washing, oxygen bleaches are preferred, for example, in the form of an inorganic persalt, preferably with a bleach precursor, or as a peroxy acid compound.

In the case of inorganic persalt bleaches, an activator or bleach precursor makes the bleaching more effective at lower temperatures, ie in the range from ambient temperature to about 60° C. Such bleach systems are commonly known as low-temperature bleach systems. The inorganic persalt such as sodium perborate, both the monohydrate and the tetrahydrate, acts to release active oxygen in solution, and the activator which is usually an organic compound having one or more reactive acyl residues which causes the formation of peroxy acids; the latter providing for more effective bleaching action at lower temperatures than the peroxybleach compound alone. A commonly used precursor is tetraacety ethylene diamine (TAED).

The ratio of the peroxybleach compound to the activator is from 20:1 to about 1:1, preferably from about 10:1 to about 1.5:1. The preferred level of the peroxybleach compound in the composition is from 0 to 30, more preferably 2 to 20 and most preferably 4 to 15% by weight.

The preferred level of activator is from 0 to 20, more preferably 1 to 10, most preferably 2 to 8% by weight of the composition.

Typical examples of suitable peroxybleach compounds are alkali-metal perborates, both tetrahydrates and monohydrates, alkali metal percarbonates, persilicates and perphosphates, of which sodium perborate and sodium percarbonate are preferred.

A further class of bleach activators are hydrophobic peroxy acid bleach precursors such as sodium nonanoyl benzene sulphonate and sodium -3,5,5-trimethyl hexanoyloxy benzene sulphonate.

It is also advantageous to include bleach catalysts and, in particular, transition metal catalysts. Such catalyst, optionally together with stabilisers, as hereinafter defined, can be used to activate peroxide compounds to make them more suitable for use for bleaching at lower temperatures, ie from 20–60° C. As stated above, such catalysts may be incorporated in the form of a particulate product according to the invention.

It may also be desirable to include in the compositions a stabiliser for the bleach or bleach system, for example hydroxyethylidene-1,1-diphosphonic acid, ethylene diamine tetramethylene phosphonate and diethylene triamine pentamethylene phosphonate or other appropriate organic phosphonates or salts thereof, such as the Dequest® range of materials.

The detergency builders are those materials which counteract the effects of calcium, or other ion, water hardness, either by precipitation or by an ion sequesteration. They comprise both inorganic and organic builders. They may also be sub-divided into the phosphorus-containing and non-phosphorus types, the latter being preferred when environmental considerations are important.

In general, the inorganic builders comprise the various phosphate-, carbonate-, silicate-, borate- and aluminosilicates-type materials, particularly the alkali-metal salt forms. Mixtures of these may also be used.

Examples of phosphorus-containing builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic builders, when present, include water-soluble alkali metal carbonates, bicarbonates, borates, silicates, metasilicates, and crystalline and amorphous aluminosilicates. Specific examples include sodium carbonate (with or without calcite seeds), potassium carbonate, sodium and potassium bicarbonates, silicates such as sodium metasilicate and zeolites.

Examples of organic builders include the alkali metal, ammonium and substituted ammonium, citrates, succinates, malonates, fatty acid sulphonates, carboxymethoxy succinates, ammonium polyacetaes, carboxylates, polycarboxylates, aminopolycarboxylates, polyacetyl carboxylates and polyhydroxysulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid. Other examples are organic phosphonate type sequestering agents such as those sold by Monsanto under the tradename of the Dequest® range and alkanehydroxy phosphonates.

Other suitable organic builders include the higher molecular weight polymers and co-polymers known to have builder properties, for example appropriate polyacrylic acid, polymaleic acid and polyacrylic/polymaleic acid co-polymers and their salts, such as those sold by BASF under the Sokalan® Trade Mark. Polyacrylates or their derivatives may also be useful for their anti-ashing properties.

Preferably the level of builder materials is from 5–50%, more preferably 10–40%, most preferably 15–35% by weight of the composition.

Other ingredients comprise those remaining ingredients which may be used in liquid cleaning products, such as fabric conditioning agents, perfumes (including deoperfumes), micro-biocides, colouring agents, soil-suspending agents (anti-redeposition agent), corrosion inhibitors, enzyme stabilising agents, and lather depressants.

The invention will now be illustrated with respect to the following non-limiting examples.

EXAMPLES

In the following examples I, II and III the bleaching performance of a non-aqueous liquid product comprising sodium perborate, TAED (in examples I and II) and a bleach catalyst protected with a range of different biopolymers was examined.

The composition of the non-aqueous liquid (NAL) to which the protected bleach catalyst of examples I and II were added is given below:

| NAL-composition | % by weight of |
|---|---|
| Alkoxylated nonionic[1] | 23 |
| Alkoxylated nonionic[2] | 19 |
| Alkyl benzene sulphonic acid[3] | 6 |
| Glycerol triacetate | 5 |
| Antifoam | 1 |
| Sodium carbonate | 17 |
| Calcite | 8 |
| Polymer[4] | 1 |
| SCMC | 1 |
| Brightener | 0.1 |
| Silica | 3 |
| Sodium perborate | 10.5 |
| TAED | 3 |
| Minors | to 100% |

[1]Vista 1012-62R ex Novel; $C_{10}$–$C_{12}$ alkyl and on average 6.5 ethoxylate nonionic
[2]Nonionic surfactant with 3 ethoxylate groups
[3]Marlon ® AS3 ex Hüls AG
[4]Versa TL3-XR ex National Starch The composition of the non-aqueous liquid (NAL) to which the protected bleach catalyst of example III was added is given below:

| NAL-composition | % by weight of |
|---|---|
| Alkoxylated nonionic[1] | 27 |
| Alkoxylated nonionic[2] | 22 |
| Alkyl benzene sulphonic acid[3] | 6 |
| Antifoam | 1.6 |
| Sodium carbonate | 17 |
| Calcite | 6 |
| Polymer[4] | 1.5 |
| SCMC | 1.5 |

-continued

| NAL-composition | % by weight of |
|---|---|
| Brightener | 0.2 |
| Silica | 4.5 |
| Sodium perborate | 10.5 |
| Minors | to 100% |

[1]Vista 1012-62R ex Novel; $C_{10}$–$C_{12}$ alkyl and on average 6.5 ethoxylate nonionic
[2]Nonionic surfactant with 3 ethoxylate groups
[3]Petrelab 550
[4]Versa TL3-XR ex National Starch The protected particulate bleach catalysts were prepared as follows. A solution of approximately 5% biopolymer in demineralised water was heated to dissolve the biopolymer. After cooling, the bleach catalyst (2% by weight based on the weight of the biopolymer) was added. The resulting solution was then poured into a dish and left to stand at ambient temperature for a period of 72 hours. Thereafter, the resulting reddish-brown coloured glassy material was milled either in a mortar to give small particles with a size of about 0.5 mm or in a Janke & Kunkel Analysen Muhle A-10 and subsequently sieved to give particles smaller than 180 μm.

The protected particulate bleach catalyst particles were then added to the detergent composition in an amount such that the level of bleach catalyst was 0.05% by weight based on the composition.

In example I the formulation was stored at ambient temperature and the bleach performance of the product measured periodically.

In examples II and III formulations were stored at a constant temperature of 37° C.

Bleaching experiments were carried out as follows on standard tea-stained test cloths.

The experiments were all carried out in a glass beaker equipped with a magnetic stirrer, heating spiral, temperature sensor and pH electrode and at a constant temperature of 40° C. Demineralised water was used.

The formulation was dosed at a level of 4 g/1 and the pH adjusted, where necessary, to give a pH of 10.5. Two or four standard tea-stained test cloths were immersed in the resulting solutions which were kept at 40° C. for a period of 30 μminutes. The test cloths were then rinsed with tap water and air dried. The reflectance (R460*) was measured on a Micromatch Reflectometer before and after treatment. The difference (ΔR460*) in the values gives a measure of the effectiveness of the treatment. The (ΔR460*) results presented below are an average for two or four test cloths.

| Example I Compositions | Bleach catalyst | Biopolymer |
|---|---|---|
| A | — | — |
| B | cat[1] | — |
| C | cat[1] | starch[5] |
| D | cat[1] | gelatine[6] |
| E | cat[1] | amylopectin from potato[7] |
| F | cat[2] | starch[5] |

In all compositions, except C, the bleach catalyst product was milled to a particle size of about 0.5 mm. In C it was milled to less than 180 μm.

cat[1]—$[Mn_2(\mu\text{-}O)_3(1,4,7\text{-}Me_3TACN)_2](PF6)_2$prepared as described in EP-A-458 397;

cat[2] —Manganese (III)-acetylacetonate$^+$ and $Me_3TACN$ (1,4,7-trimethyl-1,4,7-triazacyclononane)$^{++}$, 5—water soluble potato starch ex J. T. Baker
6—ex Gelatine Delft
7—ex Sigma
+ added in unprotected forms in the NAL composition
++ in starch

| Composition | ΔR460* After storage at ambient temp (days) 0 | 7 | 16 | 31 |
|---|---|---|---|---|
| A (control) | 8.9 | 8.1* | 9.2** | 8.2*** |
| B (control) | 22.1 | 13.9* | 12.3** | 9.3*** |
| C | 20.8 | 20.5 | 19.8 | 22.0 |
| D | 20.9 | 20.5 | 19.8 | 21.4 |
| E | 21.2 | 20.5 | 19.9 | 20.6 |
| F | 17.3 | 19.7 | 19.6 | 20.3 |

*, , *measured after 6, 15 and 44 days

The results show the bleaching performance of formulations containing the protected bleach catalyst remains relatively constant even after 31 days storage. For the control B, where the bleach catalyst was unprotected there was a significant fall-off in bleach performance.

These results demonstrate the benefit of the invention. The activity of sensitive and/or reactive species such as bleach catalysts, if protected in a biopolymer, can be maintained when they are stored in aggressive environments in which their reactivity would normally be expected to be lost or, at least, reduced to a considerable extent.

| Example II Composition | ΔR460* After storage at 37° C. (days) 0 | 8 | 19 | 32 | 77 | 153 |
|---|---|---|---|---|---|---|
| A | 8.8 | 9.5 | 9.4 | 9.2 | 8.4 | 7.2 |
| B | 21.7 | 10.8 | 10.4 | 9.7 | 8.9 | 7.3 |
| C | 21.2 | 20.7 | 20.4 | 20.4 | 19.4 | 17.4 |
| D | 21.5 | 20.5 | 20.4 | 21.0 | 18.9 | 17.7 |
| E | 20.8 | 19.9 | 19.7 | 20.3 | 18.6 | 17.8 |
| F | 20.3 | 19.6 | 20.5 | 21.0 | 19.4 | 18.0 |

The results demonstrate the benefit of protecting the bleach catalyst was maintained even when the formulation was stored at a higher temperature. Again there was a dramatic fall off in bleach performance for the control B.

Example III

In this example the effect of coating protected bleach catalysts of the type cat[1] above was examined. Particulate adjunct products of the foregoing example, containing 2% by weight of cat[1] based on the biopolymer and a particle size fraction of less than 180 μm were either i) spray dried in a NIRO Utility 1 spraydryer with air inlet and outlet temperatures of 215°–230° C. and 110°–125° C. respectively and then extruded using a Werner & Pfleiderer Twin screw extruder ZSK 30; or ii) spray dried in a Anhydro Lab Model 1 spraydryer with air inlet and outlet temperatures of 170°–180° C. and 85°–90° C. respectively and then an additional layer was added by agglomeration in a NIRO MP1 fluid bed agglomerator.

In these experiments the biopolymer used was an octenylsuccinate (OSA) ester derivative (3% treatment level based on starch dry weight) of a dextrin having a DE less than 3. In some cases this was used in conjunction with high amylose (HA), an OSA ester derivative of 70% amylose corn starch, converted to a WF of about 30–40 and cooked. Bleaching experiments were carried out as described above and the following results obtained.

| | $\Delta R_{460}$, after storage at 37° C./day | | | | |
|---|---|---|---|---|---|
| Composition | 0 | 7 ± 1 | 21 | 60 ± 1 | 69 |
| A | 24.3 | 20.4 | 23.9 | 20.1 | |
| B | 23.7 | 22.4 | 20.8 | | 21.9 |
| C | 23.3 | 21.1 | 21.4 | 20.8 | |

A — coated molecular solid solution made by spray-drying an OSA biopolymer followed by extrusion with OSA biopolymer, which is a 3% OSA ester derivative of a converted (30–40 WF) waxy maize starch;
B — coated molecular solid solution made by spray-drying an OSA biopolymer followed by extrusion with an HA biopolymer;
C — coated molecular solid solution made by spray-drying an OSA biopolymer followed by agglomeration with HA biopolymer.

The results demonstrate the benefit of coating the particles of the invention.

Example IV

In this example the storage stability of a fluorescer protected with starch[5] in a non-aqueous liquid (NAL) product comprising sodium perborate and TAED was examined.

The composition of the NAL was as follows:

| NAL-composition | % by weight |
|---|---|
| Alkoxylated nonionic[1] | 25 |
| Alkoxylated nonionic[2] | 20 |
| Alkyl benzene sulphonic acid[3] | 5 |
| Glycerol triacetate | 5 |
| Antifoam | 1 |
| Sodium carbonate | 16 |
| Calcite | 6 |
| Polymer[4] | 1 |
| SCMC | 1 |
| Brightener | 0.15 |
| Silica | 3 |
| Sodium perborate | 10 |
| TAED | 5 |
| Minors | to 100% |

[1]Vista 1012-62R ex Novel; $C_{10}$–$C_{12}$ alkyl and on average 6.5 ethoxylate nonionic
[2]Dobanol 25-3 ex Shell; $C_{12}$–$C_{15}$ alkyl and on average 3 ethoxylate nonionic

[3]Marlon ® AS3 ex Hüls AG
[4]Versa TL3-XR ex National Starch

The protected fluorescer was prepared by heating a solution of 5% starch in demineralised water to dissolve the starch. After cooling to 35° C. the fluorescer (5.3% by weight of the starch) was added and dissolved. The resulting product was milled to a particle size <180 μm. It was then dried in an oven at a temperature of 37° C. and then added with the TAED, GTA and sodium perborate monohydrate to the remaining components of the NAL in such an amount that the fluorescer was present at a level of 0.15% by weight. These formulations were mixed in a Silverson Mixer under UV free conditions.

The formulation was then separated into two 100 g batches and stored in glass jars covered with black tape at a constant temperature of 37° C. and 70% relative humidity. The % fluorescer remaining after storage was measured using a Perkin Elmer LS50 luminesence spectrometer. The following results, average of four values with two for each batch, were obtained.

For comparison purposes, a formulation was made up in which the fluorescer was added in an unprotected form.

| | % Fluorescer Remaining | |
|---|---|---|
| Storage Time/weeks | with starch | without starch |
| 0 | 100 | 100 |
| 1 | 94 | 65 |
| 2 | 90 | 56 |
| 4 | 82 | 39 |
| 8 | 76 | 39 |
| 12 | 68 | 37 |

The results demonstrate the advantage of protecting the fluorescer before adding it to an NAL.

We claim:

1. A particulate adjunct product comprising 0.01% to 30% by weight of an adjunct selected from the group consisting of bleach catalysts, bleach catalyst precursors, and bleach precursors, dissolved as a molecular solid solution in a biopolymer, the product having a water content of less than 20% by weight.

2. Adjunct product according to claim 1 characterized in that the biopolymer is selected from the group consisting of polysaccharides and polypeptides.

3. Adjunct product according to claim 2, characterized in that the biopolymer is a starch.

4. Adjunct product according to claim 3 characterized in that the biopolymer is a starch selected from high amylose maize starch, waxy maize starch, potato amylopectin and tapioca starch.

5. Adjunct product according to claim 4 characterized in that the starch is modified by dextrinization to form dextrins; or by derivatization to form ether or ester starch derivatives.

6. Adjunct according to claim 4, characterized in that the starch is modified by conversion to a lower molecular weight starch material followed by derivatization to form an octenylsuccinate starch ester derivative.

7. Non-aqueous liquid cleaning composition comprising a liquid phase and a particulate adjunct product as claimed in claim 1.

8. Adjunct product according to claim 1 characterized in that the adjunct is a transition metal bleach catalyst or a transition metal bleach catalyst precursor.

9. Adjunct product according to claim 8, characterized in that said catalyst is a transition metal salt or a transition metal coordination complex.

10. Adjunct product according to claim 1, characterized in that the adjunct is a macrocyclic organic compound.

11. Method of preparing a particulate adjunct product comprising a substantially solid molecular solution of an adjunct in a biopolymer as claimed in claim 1 characterized in that it comprises:

(i) dissolving the biopolymer in water at a weight ratio of biopolymer to water of from 1:99 to 50:50 to form an aqueous solution of the biopolymer;

(ii) dissolving the adjunct in the solution formed in step (i); and (iii) drying the solution of step (ii) to a water content of less than 20% by weight thereby forming a solid material which is a solid solution of the adjunct in the biopolymer, containing 0.01% to 30% by weight of the adjunct.

12. A composition according to claim 7 characterized in that said adjunct constitutes a bleach catalyst or bleach catalyst precursor.

13. A composition according to claim 7 characterized in that said adjunct is a ligand selected from:

(i) 1,4,7-trimethyl-1,4,7-triazacyclononane; and (ii) 1,2-bis(4,7-dimethyl-1,4,7-triaza-1-cyclononyl ethane.

14. Method according to claim 11 wherein following step iii) the solid solution is coated by a process selected from extrusion, agglomeration and spray-coating with a solution of biopolymer.

15. Method according to claim 14 wherein the solid dispersion is coated by an extrusion process wherein the solid dispersion is co-extruded with additional biopolymer.

16. Method according to claim 14 wherein following the coating step, the solid solution is dried.

17. The method according to claim 14 wherein following the coating step, the solid solution is milled to a particle size no greater than 2,000 μm.

18. A composition according to claim 7 characterized in that said adjunct is a dinuclear manganese complex catalyst selected from:

(i) $[Mn^{IV}{}_2(\mu\text{-}O)_3(1,4,7\text{-}Me_3TACN)_2](PF_6)_2$ (ii) $[Mn^{IV}{}_2(\mu\text{-}O)_3(1,2,4,7\text{-}Me_4TACN)_2](PF_6)_2$ (iii) $[Mn^{IV}{}_2(\mu\text{-}O)(\mu\text{-}OAc)_2(1,4,7\text{-}Me_3TACN)_2](PF_6)_2$ (iv) $[Mn^{III}{}_2(\mu\text{-}O)(\mu\text{-}OAc)_2(1,2,4,7\text{-}Me_4TACN)_2](PF_6)_2$ (v) $[Mn^{IV}{}_2(\mu\text{-}O)_2(\mu\text{-}O_2)(1,4,7\text{-}Me_3TACN)_2](PF_6)_2$ (vi) $[Mn^{IV}Mn^{III}(\mu\text{-}O)_2(\mu\text{-}OAc)(EB(Me_2TACN)_2)](PF_6)_2$.

* * * * *